United States Patent [19]

Gernert et al.

[11] Patent Number: 4,807,697

[45] Date of Patent: Feb. 28, 1989

[54] EXTERNAL ARTERY HEAT PIPE

[75] Inventors: Nelson J. Gernert, Elizabethtown; Donald M. Ernst, Leola; Robert M. Shaubach, Lititz, all of Pa.

[73] Assignee: Thermacore, Inc., Lancaster, Pa.

[21] Appl. No.: 157,224

[22] Filed: Feb. 18, 1988

[51] Int. Cl.[4] ..... F28D 15/02

[52] U.S. Cl. ..... 165/104.26; 122/366

[58] Field of Search ..... 165/104.26; 122/366

[56] References Cited

U.S. PATENT DOCUMENTS

| | | | |
|---|---|---|---|
| 4,274,479 | 6/1981 | Eastman | 165/104.26 |
| 4,422,501 | 12/1983 | Franklin et al. | 165/104.26 |
| 4,470,451 | 9/1984 | Alario et al. | 165/104.26 |
| 4,515,207 | 5/1985 | Alario et al. | 165/104.26 |
| 4,515,209 | 5/1985 | Maidanik et al. . | |
| 4,520,865 | 6/1985 | Bizzell . | |
| 4,545,427 | 10/1985 | Alario et al. . | |
| 4,627,487 | 12/1986 | Basiulis | 165/104.26 |

*Primary Examiner*—Albert W. Davis, Jr.

*Attorney, Agent, or Firm*—Martin Fruitman

[57] ABSTRACT

An improved heat pipe with an external artery. The longitudinal slot in the heat pipe wall which interconnects the heat pipe vapor space with the external artery is completely filled with sintered wick material and the wall of the external artery is also covered with sintered wick material. This added wick structure assures that the external artery will continue to feed liquid to the heat pipe evaporator even if a vapor bubble forms within and would otherwise block the liquid transport function of the external artery.

7 Claims, 1 Drawing Sheet

EXTERNAL ARTERY HEAT PIPE

The United States Government has rights to this invention pursuant to Contract No. NAS8-37261 between the National Aeronautics and Space Administration (NASA) and Thermacore, Inc.

SUMMARY OF THE INVENTION

This invention deals generally with heat pipes and more specifically with an improved external artery structure for transporting liquid during the heat pipe's evaporation-condensation cycle.

A heat pipe is essentially an enclosed space from which all non-condensible gases have been removed and into which a vaporizable liquid is placed. When heat is applied to one region of the enclosure, the evaporator, liquid located there evaporates and creates a higher local vapor pressure causing the vapor to move to a cooler location within the enclosure where it condenses. One typical system for returning the condensed liquid from the condenser to the evaporator is a capillary wick, usually on the interior surface of the enclosure, which transports the liquid back to the evaporator region where, since it is already located at the heated walls of the enclosure, it is once more evaporated.

Another accepted structure for returning liquid to the evaporator is an external artery. In such a structure an artery, of smaller cross section than the heat pipe enclosure containing the vapor transport space, but outside the walls of the heat pipe enclosure. The two enclosures are interconnected by short, usually small crosssection passages, at least at the evaporator and condenser regions. Both the external artery and the interconnecting passages are dimensioned so that they will transport liquid by capillary action.

The oppositely directed movement of the vapor and the liquid thus take place in separate but interconnected enclosures and do not interfere with one another. Moreover, in the theory put forth in prior art patents for this type heat pipe, for instance U.S. Pat. No. 4,515,207 by Alario et al, the spatial isolation of the liquid transport artery from the vapor space, and particularly from the source of heat, makes it less likely that boiling of liquid will occur in the liquid artery.

Nevertheless, such boiling does occur, and, as also noted in the previously mentioned patent, such boiling can cause vapor bubbles which reduce the liquid transport capability, and therefore the heat transfer ability, of the heat pipe. Alario et al actually attempt to solve the problem of locating a second liquid artery within the first one, thereby attaining further heat isolation.

The present invention takes a different approach. Rather than adding the complexity of a second artery, the structure of the present invention uses two other structural additions to the simple external artery. First, the interconnection between the main heat pipe enclosure and the artery is made a continuous slot for the entire length of the liquid artery, and the interconnecting slot is completely filled with sintered wick material. The second feature is that the entire inner surface of the liquid artery is also covered with sintered wick material.

This novel structure permits an external artery heat pipe to operate at particularly high evaporator heat inputs without deterioration due to boiling in the liquid artery. This is so not only because blocking vapor bubbles are less likely to form, but also because the sintered wick structure within the liquid artery and within the connector slot between the liquid artery and the main heat pipe acts as a liquid bypass around any bubbles which are formed in order to minimize their detrimental effect.

Unlike the structure in which there are discrete individual interconnectors which a vapor bubble can completely block, the interconnection of the present invention is a continuous slot for the entire length of the liquid artery, making total blockage by any limited size bubbles impossible. A vapor bubble in any one location along the slot is bypassed by liquid movement around the unblocked slot adjacent to the bubble.

Moreover the sintered wick structure which completely fills the interconnecting slot and covers the interior walls of the external artery also acts to bypass liquid around even a vapor bubble which might otherwise block liquid flow along the length of the artery, from condenser to evaporator.

Such a blockage would normally stop the entire function of the heat pipe since it stops the supply of liquid to the evaporator. However, in the present invention, the sintered wick around the bubble will continue to transport liquid and will prevent complete heat pipe failure.

An alternate embodiment of the present invention takes the enhanced operation even further by controlling the location of likely boiling and using that control to make blocking of the liquid flow in the artery even less likely.

Since boiling is more likely to occur in a coarser wick structure than in a fine wick structure, an alternate embodiment of the invention prescribes a coarse wick material within the interconnecting slot structure and a finer wick material in the liquid artery. Therefore, in the usual situation where the heat source is near the main heat pipe enclosure and the interconnecting slot is located between the heat source and the external artery, the coarse wick material within the slot will most likely be the original site of boiling and bubble formation. However, since the vapor bubble is a poorer heat conductor than the liquid which previously was in that location, it is then less likely that heat will be transfered to the liquid artery at that location, and therefore subsequent vapor block at the location of a bubble in the interconnecting slot is also less likely.

The present invention, therefore, substantially improves on both the structure of the basic external artery heat pipe and also on the other variations of external artery heat pipes, because it not only makes vapor blockage less likely, but also functions to bypass vapor blockages in order to continue operating.

DETAILED DESCRIPTION OF THE INVENTION

STRUCTURE OF THE PREFERRED EMBODIMENT

Figure 1:
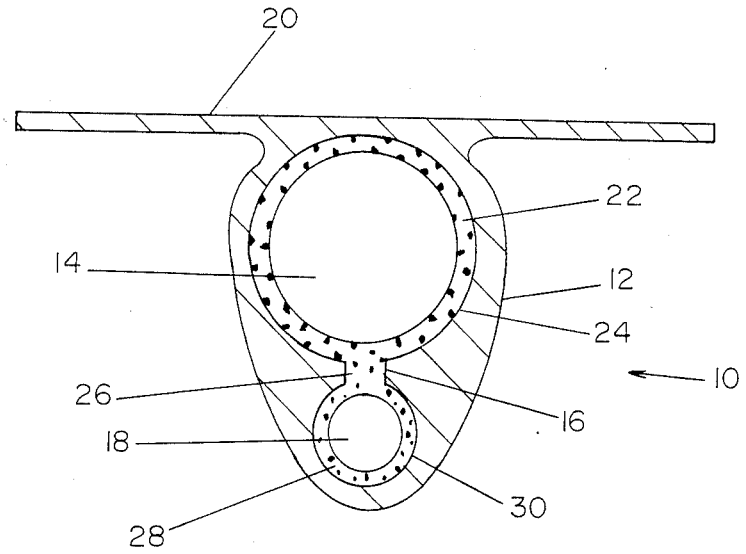
FIG. 1 is a cross section view of the preferred embodiment of the invention taken in a plane transversal to the longitudinal dimension of the heat pipe.

FIG. 1 is a cross section view of heat pipe 10 taken in a plane transverse to the direction of heat flow. Heat pipe 10 includes casing 12 which encloses vapor tube 14, interconnecting slot 16 and external artery 18, and in the preferred embodiment, casing 12 is constructed to be integral with heat transfer plate 20 which is used at the evaporator region of the heat pipe as a heat source and at the condenser region of the heat pipe as a heat sink.

A layer of sintered wick 22 is in intimate contact with inside wall 24 of vapor tube 14, while sintered wick 26 fills entire interconnecting slot 16 over its entire length and is continuous with sintered wick 22. External artery 18 also has a layer of sintered wick 28 in intimate contact with its interior wall 30 over its entire length and wick 28 is also continuous with wick 26. Thus FIG. 1 is a true representation of the typical cross section of heat pipe 10 over essentially its entire length, except for its sealed ends.

During construction, heat pipe 10 is sealed, all non-condensible gases are evacuated from the sealed enclosure, and a suitable amount of vaporizable liquid is placed within the heat pipe.

It should be noted that one alternate embodiment of the invention involves only using different pore sizes in the sintered wick layers of FIG. 1 rather than the same pore sizes. In this alternate embodiment sintered wicks 22 and 26 in vapor tube 14 and interconnecting slot 16, respectively, are coarser, with larger pore size, than sintered wick 28 of external liquid artery 18.

Figure 2:
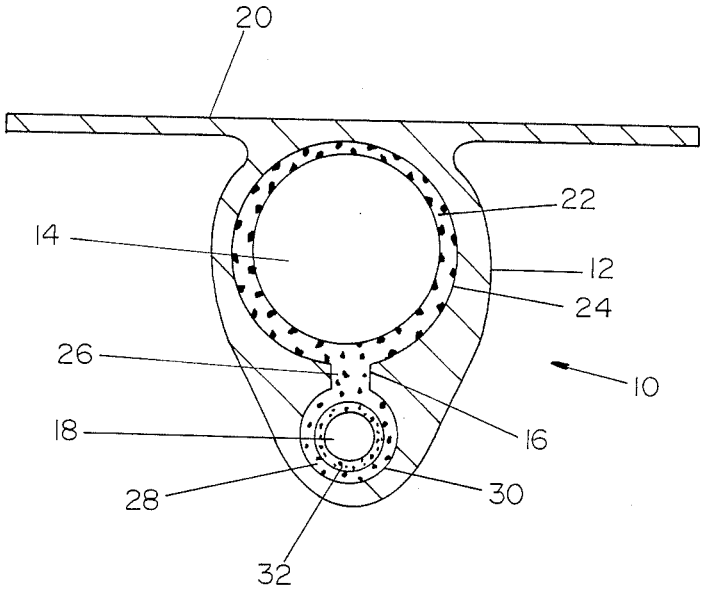
FIG. 2 is a cross section view of an alternate embodiment of the invention.

FIG. 2 shows another embodiment of the invention. In this embodiment the majority of the structure is identical to that of FIG. 1, however, an additional layer of wick is added to the inside of the wick structure within the artery. In this variation, inner wick 32 is the wick portion with finer pores, while the entire original wick structure, including wicks 22, 26 and 28, is of similar wick material which is coarser than inner wick 32. Inner wick 32 can be constructed either by sintering another layer of fine wick within the previously constructed wick structure, or another material, such as a woven fiberglass tube, can be inserted to the artery and expanded. The expansion action can be accomplished either by the compressing a tube structure during installation and depending upon its natural resiliency or using mechanical means such as expansion clips (not shown).

It is also of interest to note that in all the embodiments slot 16 is not required to have capillary properties of itself. Since the capillary action associated with slot 16 comes from the wick located within slot 16, the dimensions of slot 16 are not critical. In fact, since the wick material within slot 16 will have lower heat conductivity than the casing around it, there is some advantage to making slot 16 as wide as is practical.

OPERATION OF THE PREFERRED EMBODIMENT

The operation of heat pipe 10 of FIG. 1 is in most circumstances similar to other heat pipes. When heat is added to the evaporator region of heat pipe 10 at heat transfer plate 20, liquid which has saturated wick layer 22 in the vapor tube 14 near heat transfer plate 20 evaporates. As more heat is transferred to casing 12, liquid saturating other portions of wick layer 22 farther from plate 20 also tends to evaporate. This creates a locally high vapor pressure causing the vapor to flow axially down vapor tube 14. When the vapor reaches a cooler portion of casing 12, heat is removed by a heat sink causing the vapor to condense, and because the vapor pressure remains slightly higher than the liquid pressure the resulting condensate is pushed into wick 24 at the condenser region, through wick 26 within interconnecting slot 16 and into wick 28 and liquid external artery 18.

Because the liquid pressure is lower in the evaporator region than in the condenser region, the liquid then travels in the opposite direction from the travel of the vapor and returns to the evaporator region. At the evaporator region the liquid is pumped by capillary action through the three wick structures, first wick 28 in the external artery, then wick 26 in the interconnecting slot and then back to wick 22 in the vapor tube where it is again available for evaporation.

The continuous structure of slot 16 gives heat pipe 10 a greater versatility than any heat pipe dependent upon discrete interconnecting passages because, regardless of the particular location of the heat sink or heat source along the length of the heat pipe, the heat pipe will operate in the same manner. More important, the particular structure of the invention is most important when heat pipe 10 is operating at the limit of its heat transfer capabilities.

Under such circumstances, heat transfer from heat transfer plate 20 and through casing 12 may be sufficient to heat the liquid within external artery 18 so that it causes evaporation there. In previous external artery heat pipes, with individual discreet pipe interconnectors between vapor tube 14 and external artery 18, such vapor generation could cause a vapor bubble which would block liquid movement up to the evaporator. However, in the heat pipe described here, interconnecting slot 16 functions to bypass any bubble of limited size, and furnishes liquid around the bubble location and to the evaporator.

Another result of vapor generation in external artery 18 is that previous external arteries themselves could be entirely blocked by a vapor bubble, thus cutting off all liquid supply to the evaporator.

In the present invention, however, wick layer 28 which fully covers the inside wall of artery 18 prevents such a vapor block. Even if a bubble forms within external artery 18, wick layer 28 transports liquid around the vapor bubble by capillary action through its pores and bypasses such a blockage.

Another aspect of prevention of vapor blockage of heat pipe 10 is available from the alternate embodiments of the invention in which external artery 18 is constructed with a finer pore structure than wick 26 in interconnecting slot 16 and wick 22 in vapor tube 14.

With such a construction, with either wick 28 of finer pore structure or with inner wick 32 of finer pore structure, evaporation will occur preferentially within the larger pores of wicks 22 and 26 and be less likely to occur within external artery 18. Once a vapor bubble begins to form near interconnecting slot 16, it actually will reduce the likelihood of boiling elsewhere in external artery 18. This is because, first, the bubble acts as a better heat insulator than the liquid which previously filled the same volume, but it also is because the very action of evaporation of liquid in or near interconnecting slot 16 cools the region. The dual pore size wick of the alternate embodiments therefore further protects the present invention from vapor blockage of the external artery itself.

As a whole, the present invention permits operation of high performance heat pipes with performance capabilities as much as two times better than prior art devices. A heat pipe transporting 5 kw over 50 feet with an evaporator heat flux of 10 $W/cm^2$ is practical with the structure of the present invention.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims. For instance, as previously noted, interconnecting slot 16 could be much wider.

What is claimed is:

1. An improved external artery heat pipe structure comprising:

a vapor transport enclosure with regions located adjacent to a heat source and a heat sink, with the internal wall surface of the vapor transport enclosure covered by a first sintered wick layer, and with a continuous slot in the wall surface of the vapor transport enclosure, the slot being completely filled with a sintered wick structure which is continuous with the first sintered wick layer; and a liquid artery enclosure located outside the vapor transport enclosure with its internal surface adjacent to an open surface of the continuous slot so that the continuous slot interconnects the vapor transport enclosure to the liquid artery enclosure, with the internal wall surface of the liquid artery enclosure covered by a second sintered wick layer which is continuous with the wick structure in the continuous slot.

2. The improved external artery heat pipe structure of claim 1 wherein the first sintered wick layer in the vapor transport enclosure and the wick structure in the continuous slot are of a larger pore size than the second wick layer in the liquid artery enclosure.

3. The improved external artery heat pipe structure of claim 1 wherein the continuous slot is located over essentially the entire length of the vapor transport enclosure.

4. The improved external artery heat pipe structure of claim 1 wherein the continuous slot is interconnected with the liquid artery enclosure over essentially the entire length of the liquid artery enclosure.

5. The improved external artery heat pipe structure of claim 1 further including a third wick layer located within the liquid artery enclosure in intimate contact with the inside surface of the second sintered wick layer, the third wick layer having a finer pore structure than the other wicks within the heat pipe structure.

6. The improved external artery heat pipe structure of claim 5 wherein the third wick layer is constructed of sintered wick.

7. The improved external artery heat pipe structure of claim 5 wherein the third wick layer is constructed of a woven fiberglass tube.

* * * * *